US007775678B2

(12) United States Patent
Waffenschmidt et al.

(10) Patent No.: US 7,775,678 B2
(45) Date of Patent: Aug. 17, 2010

(54) METHOD AND DEVICE FOR GROUPING AT LEAST THREE LAMPS

(75) Inventors: Eberhard Waffenschmidt, Aachen (DE); Matthias Wendt, Wurselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 43 days.

(21) Appl. No.: 12/067,946

(22) PCT Filed: Sep. 18, 2006

(86) PCT No.: PCT/IB2006/053344

§ 371 (c)(1),
(2), (4) Date: Mar. 25, 2008

(87) PCT Pub. No.: WO2007/034399

PCT Pub. Date: Mar. 29, 2007

(65) Prior Publication Data

US 2008/0225521 A1 Sep. 18, 2008

(51) Int. Cl.
*F21V 33/00* (2006.01)

(52) U.S. Cl. ..... 362/234; 362/276; 362/802

(58) Field of Classification Search ..... 362/234, 362/85, 276, 802

See application file for complete search history.

(56) References Cited

U.S. PATENT DOCUMENTS

| | | | | |
|---|---|---|---|---|
| 6,241,364 | B1 * | 6/2001 | Want et al. | 362/234 |
| 2004/0105264 | A1 | 6/2004 | Spero | |
| 2004/0122930 | A1 | 6/2004 | Pasternak | |
| 2005/0083697 | A1 | 4/2005 | Filep | |

FOREIGN PATENT DOCUMENTS

| | | | |
|---|---|---|---|
| WO | 0213490 | A2 | 2/2002 |
| WO | 2004057927 | A1 | 7/2004 |
| WO | 2005096677 | A1 | 10/2005 |

* cited by examiner

*Primary Examiner*—John A Ward

(57) ABSTRACT

The invention relates to a method and a device for grouping at least three lamps (1) and for assigning the lamps (1) to at least one operating unit. It is time-intensive to equip one or a plurality of rooms or halls within a building with lamps (1), particularly a grouping of lamps (1), and assigning lamps (1) to at least one operating unit. Therefore, grouping of lamps (1) and assigning the lamps (1) to at least one operating unit should be simplified. In accordance with the invention, a lamp (1) emits light and the other lamps (1) measure light, and distances between the lamps (1) are determined in dependence upon at least one light value and the lamps (1) are assigned to at least one operating unit in dependence upon the distances.

8 Claims, 1 Drawing Sheet

METHOD AND DEVICE FOR GROUPING AT LEAST THREE LAMPS

Figure 1:
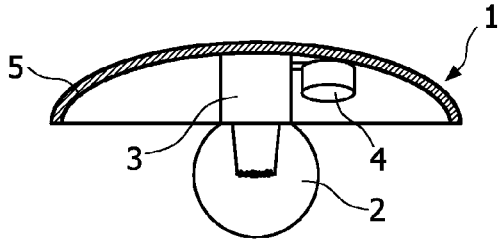

The invention relates to a method and a device for grouping at least three lamps, which comprise an illumination means, a lamp socket, a sensor and a control device having an identification and are connected to a power supply, and for assigning the lamps to at least one operating unit for switching lamps on and off by means of a control device.

Illumination devices comprising a control device are well known from US 2005/0083697 A1, which illumination devices are arranged on a rail and illuminate a target area. Sensors at the illumination devices measure rays, which are radiated by a transmitter arranged in the target area. If the rays are blocked by an object that moves between the target area and one of the illumination devices, the illumination unit controlled by the control device will move on the rail in such a manner that the target area remains free of shadows.

It is time-intensive to equip one or a plurality of rooms or halls within a building with lamps, particularly a grouping of lamps and assigning lamps to at least one operating unit.

It is therefore an object of the invention to simplify the grouping of lamps and assigning the lamps to at least one operating unit, particularly a spatial arrangement of lamps should be ascertainable.

This object is achieved in accordance with the characteristic features of the dependent claims. The method and the device are characterized in that the control device transmits a switch-on signal to a lamp for emitting light and to the other lamps for measuring light, in that one lamp emits light and the other lamps measure light, in that at least one other lamp transmits a response signal, which comprises a value of received light, in that in dependence on at least one light value the distances between the lamps are determined, in that in dependence on the distances the lamps are grouped and assigned to at least one operating unit. Depending upon boundary conditions, there are a plurality of possibilities for starting and implementing such a mode of grouping lamps and assigning the lamps to at least one operating unit. If a troublesome manual input of the identifications is omitted, the control device transmits a request signal. Lamps that have recognized the request signal respond by means of their identification. The identifications of the lamps define a temporal measure for a response. Lamps having a higher identification respond later than lamps having a lower identification within defined time intervals. Consequently, a serial response and hence one that is free of overlapping is guaranteed. After the control device has received the identifications of all the lamps involved, an arbitrary lamp is selected by the control device for emitting light. A switch-on signal is transmitted to the relevant lamp. This switch-on signal can be recognized by the other lamps as a signal to measure the ambient brightness, or, in other words, to measure receivable light by means of the sensors. After a defined unit of time, the other lamps respond in dependence upon their identification and transmit data which correspond to the received light. Alternatively, all the other lamps are queried individually with regard to the received light. The distances between the other lamps and the first lamp are determined in dependence upon the brightness measured. An estimate is sufficient. The more brightness received, the smaller the distance is. In a first approximation, a linear dependence is presupposed, because the actual distance in meters is not important, but merely the relative arrangement of the lamps to each other. Subsequently, the second lamp is triggered and the second lamp radiates light. The other lamps respond in dependence upon time, or upon request, with regard to the incoming light. If, in a further query mode, an already determined distance between two lamps is determined to be different, then an average value is obtained. Thus, a spatial arrangement of the lamps, also denoted as topology, can be determined. If a lamp does not receive light from another lamp, and vice versa, then these lamps do not see each other. If lamps do not see each other, this may be due to several reasons. The lamps are in at least two different rooms, in a multicornered room or arranged in a hall at a large distance from each other. Lamps, which actually do not see each other nor other lamps, are combined into one group and assigned to at least one operating unit. The operating unit has one or a plurality of identifications. In accordance with this assignment, a part of a room, a plurality of parts of a room or a room or a hall can be completely illuminated by means of the operating unit. Advantageously, one or a plurality of operating units have one or a plurality of switches, buttons, change-over switches or light-adjusting switches, also denoted as dimmers. Furthermore, one or a plurality of operating units can be construed as decentralized timers, motion detectors or remote controls, which transmit switch-on and switch-off signals via infrared, radio, light or ultrasonic waves. Before starting the query mode, also denoted as configuration process, the ambient brightness is measured with the lamps switched off in order to suppress an influence of the ambient brightness, i.e. of the light not generated by one or a plurality of the lamps. This measured value is then taken into consideration with the values calculated in further measurements, i.e. subtracted. It is advantageous to define a threshold value in order to implement such a query mode. If the room is influenced too much by daylight, so that there is a high ambient brightness, then the query mode is adjourned to another time. It is advantageous to implement these query modes in the darkness at night or at least during twilight. Alternatively, sunshades or shutters can be closed in order to create darkness artificially. Then the light measurement by means of the sensors remains uninfluenced by daylight. The daylight can be used for the purpose of identifying lamps that are arranged on the side of a window.

Simple light bulbs, fluorescent illumination means, compact fluorescent illumination means, halogen lamps and light-emitting diodes or LED for short can be used as illumination means. In lamps having color-variable illuminants, photo sensors are utilized in order to measure light brightness and color and to readjust the color-variable illuminants accordingly. Advantageously, these sensors can be used at the same time as sensors for detecting adjacent lamps. In order to determine a precise position, sensors can be advantageously focused, particularly on the region below the lamp, which is illuminated by the lamp light. Thus, an even more precise determination of the position of the lamp can be obtained.

Another alternative is placing a lamp having an identification at a defined location, transferring this identification and the location into the control device and starting a query mode. Then a request signal can be transmitted and lamps that recognize the request signal respond. It is useful if the manufacturer defines a set of lamps for a room or a building and thus predefines target identifications and response times. This lamp set is given a continuous numbering, so that a simple input of the start and end identification into the control device is possible. The control device then generates identifications lying in between these extremes.

A plurality of alternatives is available for communication between the control device, the lamps and the switches. In a first embodiment, the control device is connected to a power supply by means of a mains cable, which simultaneously supplies power to the lamps and the switches. Then control commands can be exchanged between the control device, the lamps and the switches via the electrically conductive cables of the power supply. This means that the electrically conductive cables are provided both for power supply and data exchange. This method is referred to as power line communication.

In a second embodiment, control commands can be wirelessly exchanged as broadcast signals between the control device, the lamps and the switches.

In a third embodiment, separate electrically conductive cables are arranged between the control device, the lamps and the switches, via which data exchange takes place.

In a fourth embodiment, the light of the illumination units can be modulated and data exchange takes place via the light modulation. Advantageously, this light modulation is not perceptible by the human eye.

Figure 2A:
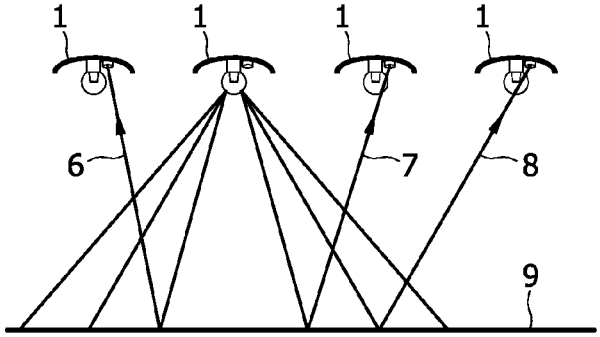
Figure 2B:
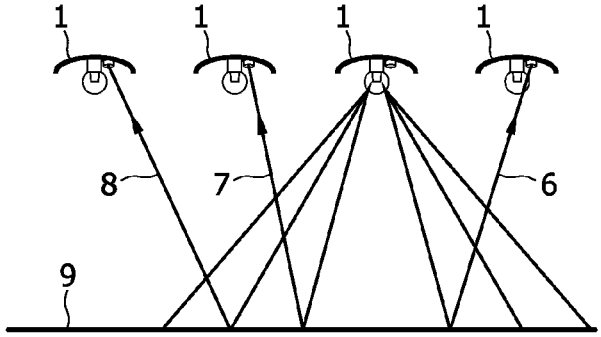
Figure 2C:
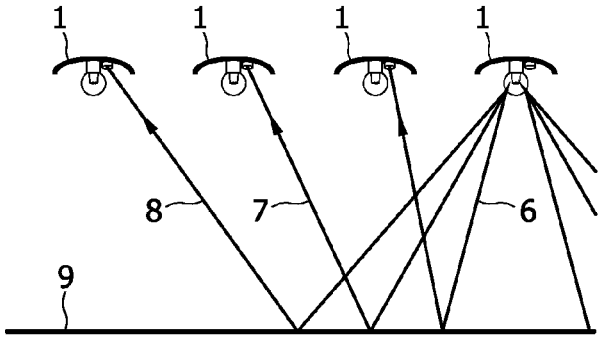

These and other aspects of the invention are apparent from and will be elucidated with reference to the embodiments described hereinafter In the drawings:

FIG. 1 shows a lamp with a socket, an illumination means and a sensor in a partially sectional side view, FIG. 2A is a schematic representation of an arrangement of four lamps, of which one lamp radiates light and the other three measure light that can be received, FIG. 2B is a schematic representation of the arrangement of four lamps, of which another lamp radiates light and the other three measure light that can be received, FIG. 2*c* is a schematic representation of the arrangement of four lamps, of which a third lamp radiates light and the other three measure light that can be received.

In the different Figures, similar or identical elements are denoted by the same reference symbols.

FIG. 1 shows a lamp 1 with an illumination means 2, a lamp socket 3, a sensor 4 and a reflector 5.

FIG. 2A shows four lamps 1 arranged in a row. The second lamp 1 from the left is switched on and radiates light beams 6, 7 and 8, which are reflected by the floor 9 and are received by sensors 4 of the adjacent lamps 1. The light beams 6 and 7 to the sensors 4 of directly adjacent lamps 1 cover a shorter distance than the light beam 8 to the sensor 4 of a more distant lamp 1 on the right-hand side. When impinging on the sensor 4, the light beams 6 and 7 covering the shorter distance have a higher intensity than the light beam 8 covering the longer distance. The sensors 4 of directly adjacent lamps 1 thus detect higher light values than the sensor 4 of the more distant lamp 1.

FIG. 2B also shows the four lamps 1 arranged in a row. The third lamp 1 from the left is switched on and radiates light beams 6, 7 and 8, which are reflected by the floor 9 and are received by sensors 4 of the adjacent lamps 1. The light beams 6 and 7 to the sensors 4 of directly adjacent lamps 1 cover a shorter distance than the light beam 8 to the sensor 4 of a more distant lamp 1 on the left-hand side. When impinging on the sensor 4, the light beams 6 and 7 covering a shorter distance have a higher intensity than the light beam 8 covering a longer distance. The sensors 4 of directly adjacent lamps 1 thus detect higher light values than the sensor 4 of the more distant lamp 1.

FIG. 2C also shows the four lamps 1 arranged in a row. The fourth lamp 1 from the left is switched on and radiates light beams 6, 7 and 8, which are reflected by the floor 9 and received by the sensors 4 of the adjacent lamps 1. A first lamp 1 is directly adjacent, a second lamp 1 is at a large distance from the light-radiating lamp 1 and a third lamp is at an even larger distance. The light beam 6 covers a long distance, the light beam 7 covers a longer distance and the light beam 8 covers an even longer distance. The intensity of the light beams 6, 7 and 8 decreases with the length of the distance covered and is consequently different when impinging on the sensor 4; a statement can thus be made about a topology of the lamps 1.

LIST OF REFERENCE NUMERALS

1 Lamp
2 Illumination means
3 Lamp socket
4 Sensor
5 Reflector
6 Light beam
7 Light beam
8 Light beam
9 Floor

The invention claimed is:

1. A method for grouping a plurality of lamps including at least three lamps, wherein each lamp is associated with a sensor configured to measure a value of light, comprising the steps of:

sequentially emitting light from each lamp of the plurality of lamps;

for each emitting lamp, measuring the value of the light by each sensor other than the sensor associated with the emitting lamp;

generating, in response to the measuring step, a response signal indicative of the value of the light forming a plurality of response signals; and grouping the plurality of lamps based on the plurality of signals.

2. The method of claim 1, further comprising:

determining a topology of the plurality of lamps based on the plurality of signals; and grouping the plurality of lamps based on the topology.

3. The method of claim 1, further comprising:

determining distances between lamps in the plurality of lamps based on the plurality of signals; and grouping the plurality of lamps based on the distances.

4. The method of claim 1, further comprising:

transmitting a request signal before the emitting step such that the emitting is initialized by the request signal.

5. The method of claim 1, further comprising transmitting a request signal before the emitting step for each lamp such that the emitting lamp is identified by the request signal.

6. The method of claim 1, wherein the grouping forms at least one group of lamps, further comprising:

assigning the at least one group of lamps to an operating unit.

7. The method of claim 6, further comprising:

communicating the plurality of response signals to the operating unit, wherein the communicating utilizes a communication means selected from a power supply, a broadcast signal, a light modulating, and a combination thereof.

8. The method of claim 1, wherein the value of light is selected from an intensity of the light, brightness of the light, and a combination thereof.

* * * * *